US006619502B2

(12) United States Patent
Walther et al.

(10) Patent No.: US 6,619,502 B2
(45) Date of Patent: Sep. 16, 2003

(54) VERTICAL CORNER TRANSITION ARRANGEMENT FOR SEMI-MEMBRANE TANK

(75) Inventors: Thomas Walther, Waterford, CT (US); David Jordan, Pawcatuck, CT (US)

(73) Assignee: Electric Boat Corporation, Groton, CT (US)

( * ) Notice: Subject to any disclaimer, the term of this patent is extended or adjusted under 35 U.S.C. 154(b) by 0 days.

(21) Appl. No.: 10/045,452

(22) Filed: Oct. 25, 2001

(65) Prior Publication Data

US 2003/0080134 A1 May 1, 2003

(51) Int. Cl.[7] ..... B65D 25/00

(52) U.S. Cl. ..... 220/639; 220/4.12; 220/678; 220/679; 52/729.1

(58) Field of Search ..... 220/639, 4.12, 220/4.15, 678, 679, 901; 52/729.1

(56) References Cited

U.S. PATENT DOCUMENTS

| | | | | | |
|---|---|---|---|---|---|
| 2,684,170 | A | * | 7/1954 | Schmitz | 220/901 X |
| 3,166,212 | A | * | 1/1965 | Resos | 220/901 X |
| 3,314,567 | A | | 4/1967 | Becker et al. | |
| 3,414,155 | A | | 12/1968 | Corvino | |
| 3,448,885 | A | * | 6/1969 | Parks | 220/901 X |
| 3,547,302 | A | | 12/1970 | Jackson et al. | |
| 3,721,362 | A | | 3/1973 | Bridges et al. | |
| 3,814,290 | A | * | 6/1974 | Gerhard | 220/1.5 X |
| 3,941,272 | A | * | 3/1976 | McLaughlin | 220/901 X |
| 3,978,808 | A | | 9/1976 | Cuneo et al. | |
| 4,000,711 | A | | 1/1977 | Okamoto et al. | |
| 4,013,030 | A | | 3/1977 | Stafford | |
| 4,173,936 | A | | 11/1979 | Secord et al. | |
| 4,182,254 | A | | 1/1980 | Secord | |
| 4,302,913 | A | * | 12/1981 | Schwartz et al. | 52/729.1 |
| 4,459,929 | A | * | 7/1984 | Ffooks | 220/901 X |
| 5,233,807 | A | * | 8/1993 | Spera | 52/729.1 |
| 5,727,492 | A | | 3/1998 | Cuneo et al. | |

* cited by examiner

*Primary Examiner*—Steven Pollard

(57) ABSTRACT

In the vertical corner transition arrangement for semi-membrane tanks disclosed in the specification, curved horizontal sides plate of a semi-membrane tank wall are welded to one side of a vertical extruded aluminum modified I-beam with a vertical tapered stiffening corner block projection on the opposite side of the extruded aluminum I-beam, and the edge of a vertical unstiffened curved cylinder section is butt-welded to the projecting edge of the vertical tapered stiffening corner block. The curved plates of an orthogonally oriented semi-membrane tank wall are welded to one side of another vertical extruded I-beam member having a projecting vertical tapered stiffening corner block welded to the opposite side with a projecting edge which is welded to the opposite edge of the vertical stiffened curved cylinder section to complete the corner of the tank.

5 Claims, 3 Drawing Sheets

VERTICAL CORNER TRANSITION ARRANGEMENT FOR SEMI-MEMBRANE TANK

BACKGROUND OF THE INVENTION

This invention relates to corner structures for semi-membrane tanks of the type frequently used to hold liquids at cryogenic temperatures.

U.S. Pat. No. 5,727,492 discloses a semi-membrane tank for holding liquefied gases such as liquefied natural gas (LNG). As described in that patent the walls of semimembrane tanks consist of curved plates having horizontal edges which are welded together and are joined at their corners to a vertical cylindrical corner by hot forming the ends of the curved plates in order to obtain a square edge for welding to the edge of the vertical corner. This arrangement tends to produce high stresses at the transition between the curved plates and the vertical corner cylinder and the radical change in shape from the curved section to the square edge at the attachment point results in stress concentrations.

In the Becker et al. U.S. Pat. No. 3,314,567, the corner of a liquid storage tank is provided by a cylindrically shaped wall member extending through an approximately 90° arc which is butt welded at each end to orthogonally oriented beam members having angular projections to which the cylindrical walls are welded. The Corvino U.S. Pat. No. 3,414,155 provides a corner for an LNG tank consisting of a vertical beam with a curved outer section and a right angle inner section to which the orthogonally extending wall members are joined. In the Bridges et al. U.S. Pat. No. 3,721,362, tank corners are provided by specially shaped transition members to which oppositely directed corrugated members in adjacent orthogonal walls are welded.

SUMMARY OF THE INVENTION

Accordingly, it is an object of the present invention to provide a vertical corner transition arrangement for semi-membrane tanks which overcomes disadvantages of the prior art.

Another object of the present invention is to provide a vertical corner transition arrangement for semi-membrane tanks which eliminates potential fatigue cracking at the interface between the curved tank wall plates and the vertical cylindrical corners and improves the overall ability to manufacture such corners.

These and other objects of the invention are attained by providing a modified extruded vertical aluminum I-beam having a center web to which the ends of horizontal curved wall sections of the tank are welded on one side and a vertical tapered stiffening corner block is welded on the opposite side so that an unstiffened vertical curved cylinder section can be butt-welded to the projecting narrow end of the stiffening corner block. With this arrangement high stresses in the corner sections are reduced and manufacture of the corner sections is facilitated since there is no need to transition curved side and end plates into a flat vertical corner plate.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
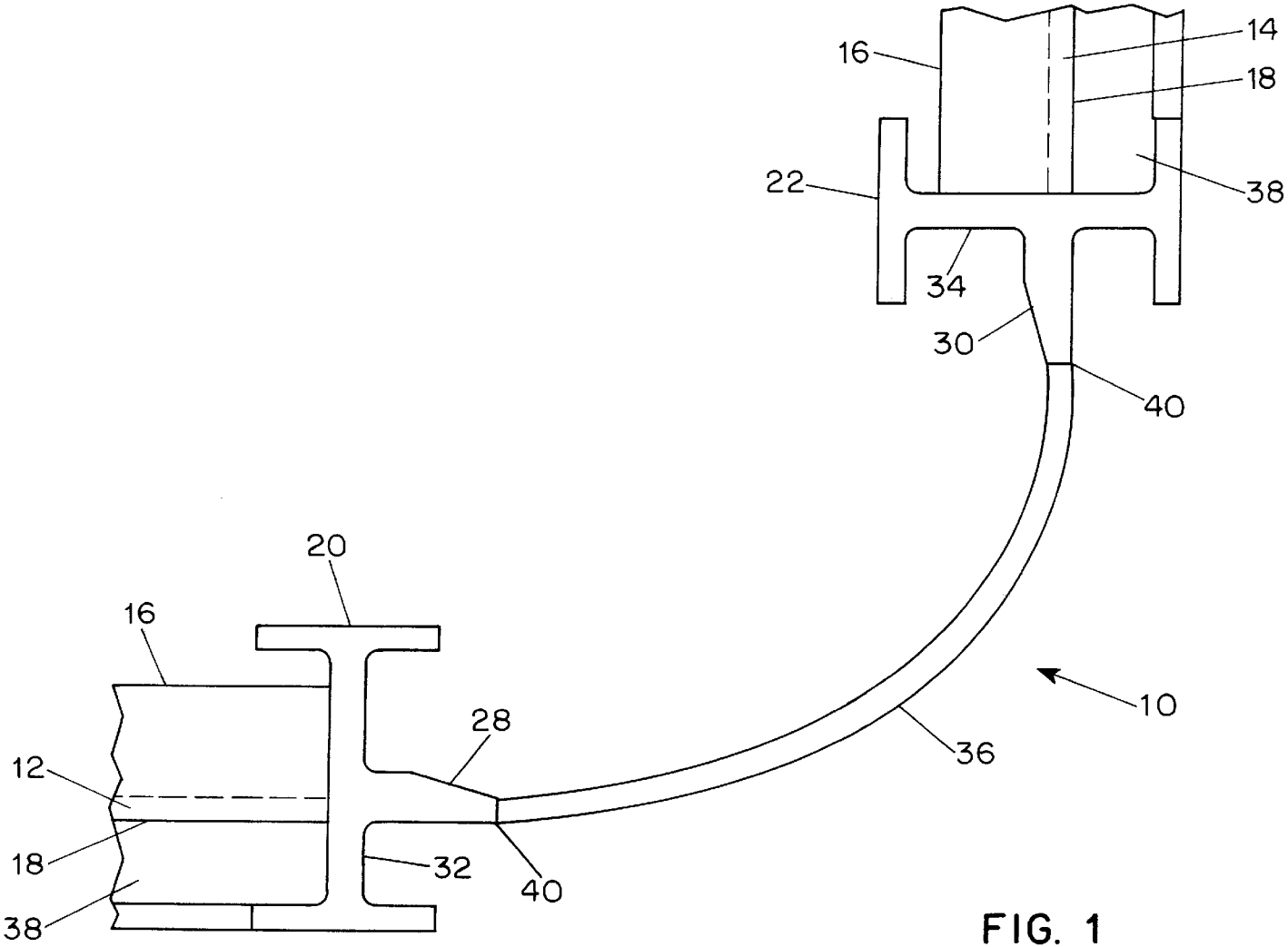
FIG. 1 is a schematic plan view illustrating a representative embodiment of a vertical corner transition arrangement for semi-membrane tanks in accordance with the invention.
Figure 2:
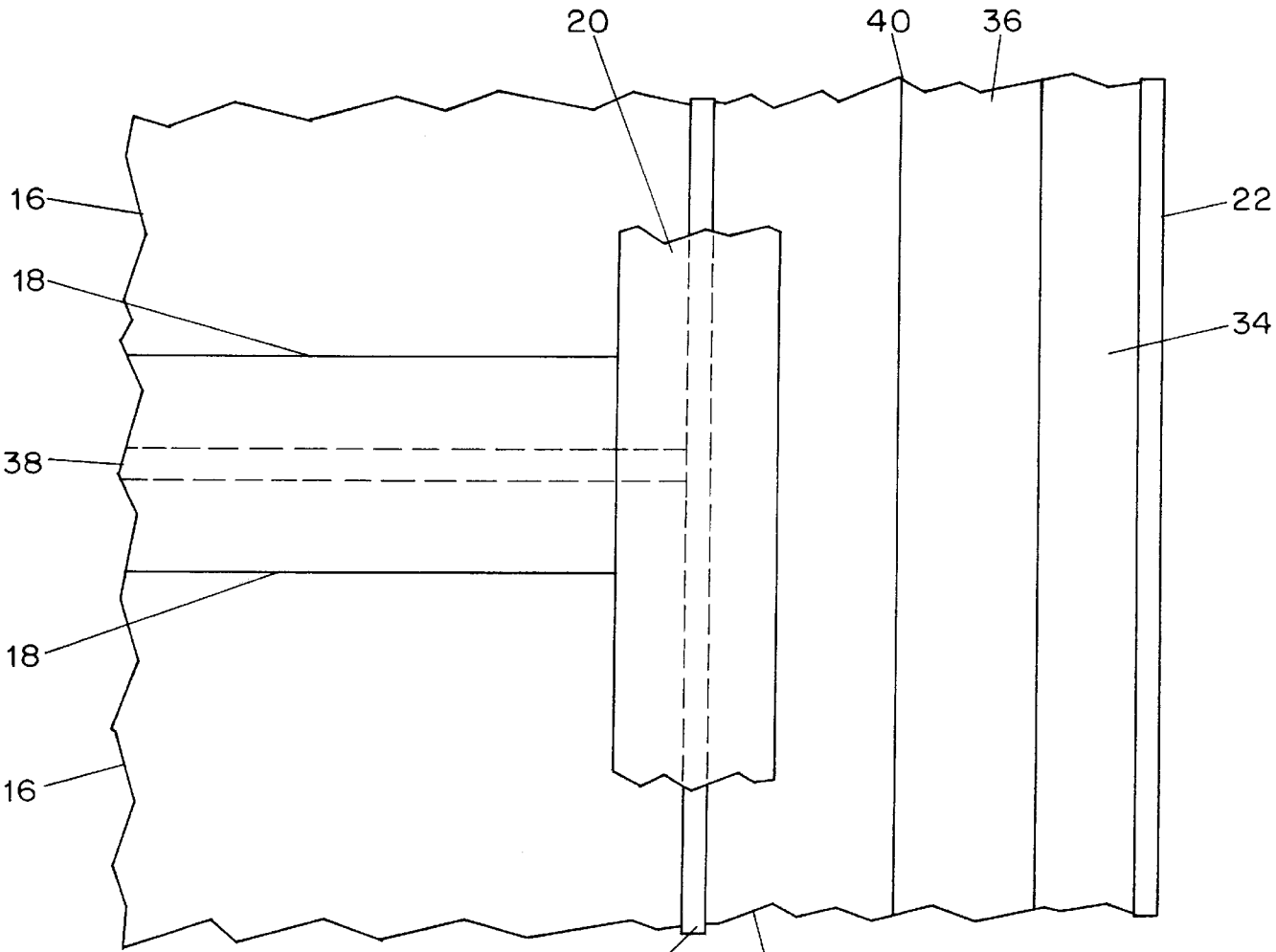
FIG. 2 is a side view of the arrangement shown in FIG. 1.
Figure 3:
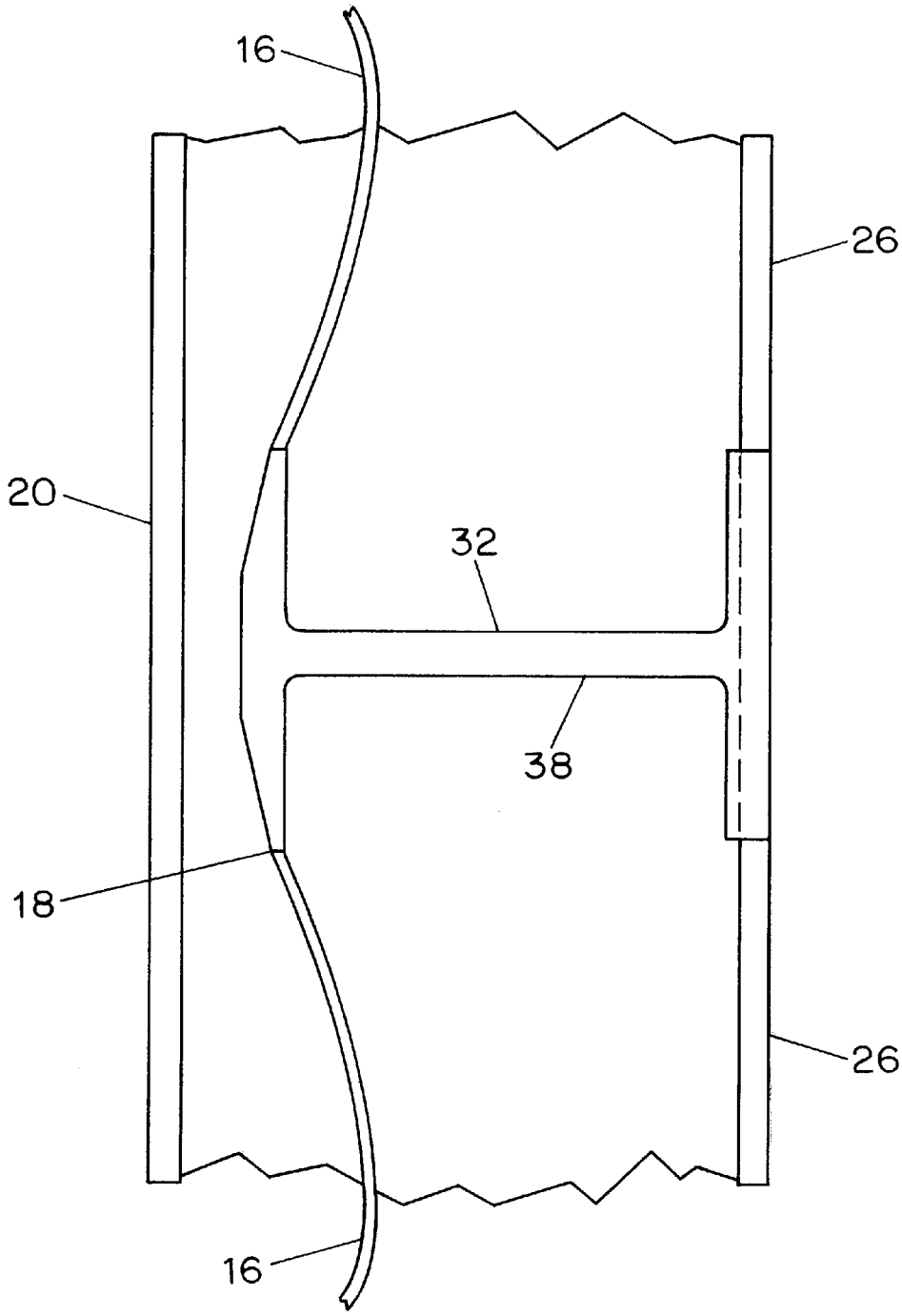
FIG. 3 is an end view of the arrangement shown in FIG. 1 looking from the left as FIG. 2.

In the representative embodiment of the invention illustrated in the drawings, a vertical corner transition arrangement 10 joins two orthogonally oriented semi-membrane tank walls 12 and 14, each of which consists of curved side plates 16 having edges 18 which are welded to corresponding edges of an extruded H-section 38, as best seen in FIG. 3, and the ends of the plates 16 in each of the walls 12 and 14 is welded to one of two extruded modified I-beams 20 and 22. The extruded H-sections 38 used to join the curved side plates 18 are aligned with the outermost surfaces 26 of the modified I-beams as shown in FIG. 3. Vertical tapered stiffening corner blocks 28 and 30 are incorporated into the central webs 32 and 34 of the modified I-beams, respectively, and a vertical unstiffened curved cylinder portion 36 is welded to the projecting edges 40 of the stiffening corner blocks 28 and 30 to complete the transition.

The modified I-beams 20 and 22, preferably fabricated by aluminum extrusion to reduce welding and ensure that the member develops the full strength of the material by eliminating the heat affected zone (HAZ), constitute structural support members providing additional strength to the corners of the tank structure, thereby resisting the significant pressure loads applied by the liquefied gas cargo during rolling and pitching motions of a ship. The unstiffened vertical curved cylinder 36 is fabricated by cold forming, preferably plate rolling, an aluminum plate and is of sufficient thickness to be capable of resisting the high stresses resulting from such dynamic loading at the corners of the tank. By using extrusions rather than rolled members the problem of potential lamellar tearing or separation is eliminated and the joint functions as a homogenous member.

Although the invention has been described herein with reference to a specific embodiment many modifications and variations therein will readily occur to those skilled in the art. For example, the vertical tapered stiffening corner block could be replaced by two blocks of different thickness welded together to provide a projecting edge matching the thickness of the curved cylindrical portion. Accordingly, all such variations and modifications are included within the intended scope of the invention.

We claim:

1. A vertical corner transition arrangement for semi-membrane tank walls comprising:

a vertical aluminum I-beam to which the ends of curved wall sections of a semi-membrane tank are welded on one side;

a vertical stiffening corner block extrusion on the opposite side of the I-beam and having a projecting edge; and a vertical curved aluminum cylinder section having an edge butt-welded to the projecting edge of the corner block.

2. A vertical corner transition arrangement according to claim 1 wherein the I-beam and the stiffening corner block are made from extruded aluminum.

3. A vertical corner transition arrangement according to claim 1 wherein the vertical curved cylinder section is an unstiffened member.

4. A vertical corner transition arrangement according to claim 1 including a further vertical aluminum I-beam to which curved plates of an orthogonal wall are welded on one side and a further vertical extruded stiffening corner block is joined on the opposite side having a projected edge to which another edge of the vertical curved cylinder section is welded.

5. A vertical corner transition arrangement according to claim 1 wherein the vertical stiffening corner block is tapered toward the projecting edge.

* * * * *